United States Patent [19]

Dozier

[11] 4,356,469

[45] Oct. 26, 1982

[54] ELECTRICAL TERMINAL WITH THERMAL INTERRUPTER

[76] Inventor: Hilliard Dozier, c/o U.S. Terminals, Inc. 7502 Camargo Rd., Cincinnati, Ohio 45243

[21] Appl. No.: 208,660

[22] Filed: Nov. 20, 1980

[51] Int. Cl.[3] ..... H01H 37/76

[52] U.S. Cl. ..... 337/401; 337/409

[58] Field of Search ..... 337/409, 408, 407, 401, 337/404

[56] References Cited

U.S. PATENT DOCUMENTS 4,126,845 11/1978 Iimori et al. ..... 337/409

*Primary Examiner*—Harold Broome

*Attorney, Agent, or Firm*—Frost & Jacobs

[57] ABSTRACT

A temperature responsive terminal pin construction having an aligned pair of terminal pin parts inserted in the opposite ends of a casing with the inner ends of the pin parts in spaced apart relation, a split ring collet surrounding the pin parts, the collet being axially displaceable under spring pressure from a first position of use in which the collet makes electrical contact with both pin parts to a second position in which the collet is out of contact with one of the pin parts, the collet being held in its first position by the nose of thermosensitive annular ring secured to the casing, the nose of the ring engaging an enlarged head on the collet. Excessive heating of the terminal pins will cause the nose of the thermosensitive ring to melt at a predetermined temperature to release the collet for axial movement. Coacting cam surfaces on the nose of the thermosensitive ring and the head of the collet act to urge the collet into tight electrical contact with the pin parts. The configuration of the pin parts facilitates the sealing of the terminal pin to a supporting body by means of a molded dielectric sealing member. Protective sleeves are provided for the inner pin parts in applications where conductive contaminants are encountered.

19 Claims, 5 Drawing Figures

ELECTRICAL TERMINAL WITH THERMAL INTERRUPTER

BACKGROUND OF THE INVENTION

This invention relates to electrical terminals and has to do primarily with terminals of the type wherein one or more conductor pins project through and are secured to a supporting body by means of a seal which electrically insulates each conductor pin from the supporting body and at the same time hermetically seals the pin against the exchange of atmosphere between one side of the terminal body and the other. Terminals of this character are widely used in refrigeration headers, wherein an electrical connection is made with components mounted within a sealed housing, as well as in transformers, relays, switches, and other types of electrical equipment. The invention will be described as it applies to a refrigeration header, although it will be understood that it may be used in conjunction with other types of terminals.

Refrigeration headers in current use are of basically two types. The first type is the so-called "hard seal" type in which the conductor pins are mounted in the supporting body by means of glass-to-metal or ceramic-to-metal seals. The second type is the so-called "soft seal" type in which the conductor pins are electrically insulated and hermetically sealed relative to the supporting body by means of a dielectric sealing material, such as an epoxy molding compound. Irrespective of which type of terminal is used, serious problems can result if excessive heat is encountered due to improper electrical connections, conductive contamination within the refrigeration system which results in internal arcing between conductors or conductors to ground, and to malfunctioning equipment. For example, in the case of a "hard seal" refrigeration header, instances of terminal pin venting have been encountered where the thermal expansion of the terminal pins has caused the seals to crack, thereby instantaneously releasing the refrigerant, oil, and contamination products from the compressor housing, the terminal seals and pins literally blowing out of the supporting body. In the case of "soft seal" terminals, excessive heat can cause degradation of the insulating material resulting in leakage of the gases around the terminal pins, and in some instances internal arcing, caused by conductive contaminants, can cause arcing and melting away of the terminal pins themselves, thus possibly venting the contents of the compressor.

While various types of temperature responsive circuit interrupters have hitherto been proposed, they have been directed primarily to devices for sensing ambient and surface temperatures of devices operating at relatively low currents, the devices acting as a one-time thermostat. Such devices utilize thermally sensitive pellets which act to release a spring-biased contact as the pellet melts. While effective, the current interrupting action of such devices is slow in operation in that a relatively large mass of material must be melted and caused to flow before the gap between conducting members is at the maximum.

In contrast to the foregoing, the present invention contemplates the provision of a heavy duty terminal pin construction which is insensitive to high current flow and yet is highly sensitive to the selected trip temperature and which will interrupt the circuit with a very fast action when the predetermined temperature level is reached. Fast tripping action is desirable for high currents and high voltages in order to minimize arcing between the conducting members during separation.

BRIEF SUMMARY OF THE INVENTION

The present invention contemplates a terminal construction wherein the terminal pins are formed in two coaxial parts lying in spaced apart relation, the spaced apart ends of the pins lying within a housing surrounding and enclosing the inner ends of the pins. The enclosed inner ends of the pins are surrounded by a split ring collet formed from a conductive material, such as copper, which normally serves to electrically connect the pin parts, the cross-sectional area of the collet being essentially equal to the cross-sectional area of the pin parts so that the flow of current from one pin part to the other will not be impeded by the collet.

The collet has an enlarged head at one end and is surrounded by a conductive sleeve having an annular flange which engages the enlarged head on the collet, the sleeve in turn being surrounded by a helical spring extending between the flanged end of the sleeve and a seat formed as a part of the casing. The spring is thus positioned to displace the collet axially with respect to the pin parts, such axial displacement acting to remove the collet from contact with one of the pin parts and hence break the electrical connection between the pin parts.

Axial displacement of the collet is normally prevented by an annular ring formed from a normally rigid thermosensitive material, the thermal ring having a tapered annular nose which engages a mating tapered annular surface on the head of the collet, the nose of the thermal ring serving to normally restrain axial displacement of the collet. In addition, the tapered surfaces of the collet and thermal ring coact to wedge the collet into tight engagement with the pin parts under the pressure exerted by the spring, thereby insuring positive electrical contact between the parts.

With the arrangement just described, the normally rigid thermally sensitive ring, which may comprise any one of a known group of materials which are formulated to melt within a very narrow temperature range, normally retains the collet in tight electrical contact with the pins. However, if overheating of the pin parts occurs, the heat will be quickly transmitted to the thermal ring both through the collet and through the surrounding casing, and the nose of the thermal ring will be quickly melted when its predetermined melting point is reached. Since the collet is restrained solely by the tapered nose of the thermal ring, melting of the nose will effectively release the collet for displacement under the influence of the spring, the releasing action taking place essentially instantaneously. Of course, when the collet is released for axial movement, it moves out of contact with one of the pin parts and the electrical circuit is interrupted.

Terminal pins in accordance with the invention may be readily fabricated and installed in their supporting body in conventional fashion, as by means of a molded dielectric sealing member, or by glass or ceramic seals.

When terminal pins in accordance with the invention are used in hermetic refrigeration compressor applications wherein contaminants within the refrigeration system are conductive and can be deposited over the insulating surfaces of the terminal headers, the deposited contaminants can cause excessive heating of the terminal pins due to the leakage of current between the terminal pins or between pins to ground. If large quantities of contaminants are present, arcing and melting of the terminal pins can occur quite rapidly. In order to provide arc protection under these conditions, the inner ends of the terminal pins are provided with arc protectors, preferably in the form of graphite sleeves, which shield the pins from arcing and at the same time act to transfer heat to the pins to enhance early and rapid tripping of the pins.

DETAILED DESCRIPTION

Figure 1:
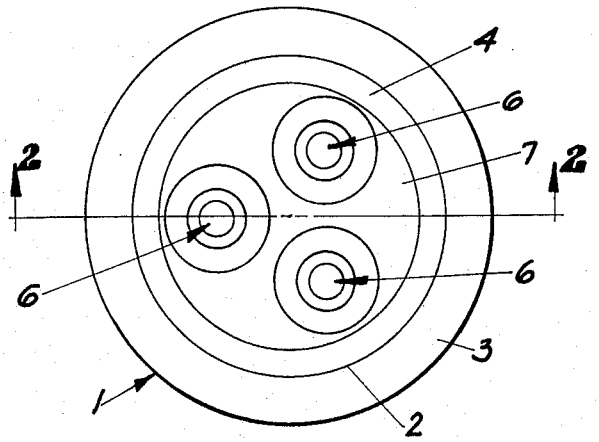
FIG. 1 is a top plan view of an exemplary terminal construction comprising a three-conductor header of the type used in compressors for refrigeration equipment.
Figure 2:
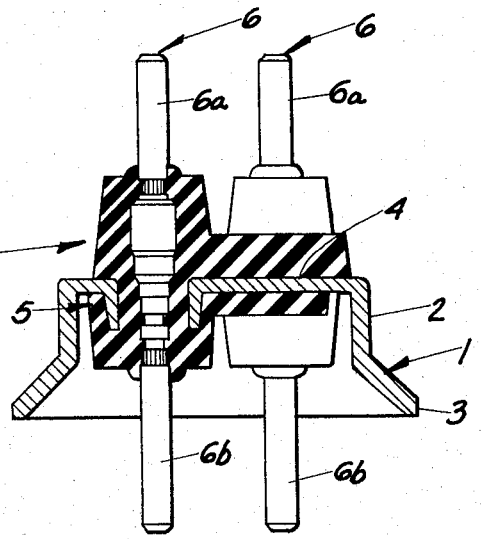
FIG. 2 is a vertically sectional view taken along the line 2—2 of FIG. 1.

Referring first to FIGS. 1 and 2 of the drawings, the terminal comprises a supporting member or body 1 which, in the embodiment illustrated, is of cup-shape configuration, the supporting body having an annular wall 2 terminating at one end in an outturned flange 3 and at its opposite end in a base 4 interrupted by spaced apart sleeves or sockets 5 lying within the confines of body wall 2. The configuration just described is conventional for a three-pin refrigeration header. A steel body is normally used since it is relatively inexpensive, can be easily formed into the desired shape, and is readily welded into the compressor shell.

The terminal pins are generally indicated at 6, the pins extending axially through the sleeves 5 and being secured in place and hermetically sealed by means of a sealing member 7, which is preferably a unitary member composed of a dielectric material molded in situ to the desired configuration. The sealing member will be molded from a compound having sufficiently low resistance to flow so that the direction and extent of flow may be controlled during molding, the compound having a coefficient of linear-thermal expansion which is compatible with the coefficient of expansion of the pins, the pins preferably being formed of copper or copper alloy which have a high current carrying capacity. Epoxy molding compounds have been found to produce excellent results, particularly when fortified with mineral or glass fibers. Excellent results have been achieved using epoxy molding compounds manufactured by Plaskon Products Inc. under the trademark PLASKON. In addition to epoxy molding compounds, which are essentially rigid when cured, distortable dielectric materials, such as synthetic elastomers, which are relatively soft and capable of being flexed, also may be employed. For example, chlorosulfonated polyethylene manufactured by E. I. DuPont de Nemours & Co. under the trademark HYPALON may be used. Where a material such as HYPALON is used, a bonding adhesive is required to insure a tight bond between the metal body and the seal.

It will be understood that the general organization and arrangement of the parts thus far described is essentially conventional, the present invention dealing with the construction of the terminal pins to provide temperature responsive interruption of the current flow through the pins.

Figure 3:
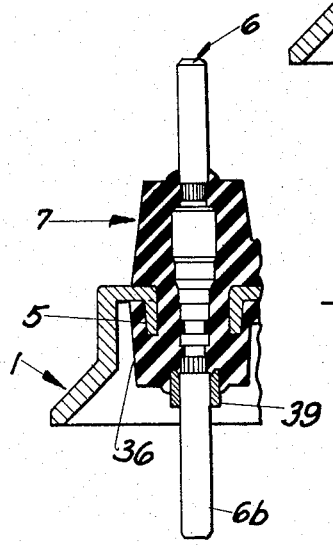
FIG. 3 is an enlarged fragmentary vertical sectional view illustrating the terminal pin in its normal position of use.

Referring next to FIG. 3, the terminal pin 6 has an upper pin part **6*a* and a lower pin part 6*b* in coaxial alignment, the facing ends of the parts being spaced apart to define a gap 8 therebetween. The upper pin part 6*a* has a knurled body portion 9, a shoulder 10, and a stem 11 terminating in a flat face 12 defining one side of gap 8. A dielectric cap 13 surrounds and is press fitted to the stem 11, the cap seating against the shoulder 10. The cap is provided with an annular seat 14, which preferably comprises a metal ring, adapted to be engaged at its outer extremity by an annular shoulder 15 of casing 16, the open end 17 of the casing being crimped about the periphery of the cap 13** to secure the cap to the casing. Preferably the casing will comprise a conductive material, such as copper plated steel.

At its opposite end the casing terminates in a neck 18 which is press fitted to a body portion 19 of lower pin part **6*b*, the neck seating against a shoulder 20 at the outer end of body portion 19. The lower pin part also including a second shoulder 21 spaced from shoulder 20 and a knurled body portion 22 which is preferably tapered. At its opposite end the lower pin part defines a stem 23 having a slightly enlarged head 24 terminating in a flat face 25 defining the opposite side of the gap 8**.

Electrical contact is normally maintained between pin parts **6*a* and 6*b* by means of a two or four piece split collet 26 which bridges the gap 8 and makes electrical contact with both pin parts. To this end, the cross-sectional area of the collet is substantially equal to the cross-sectional area of the stems 11 and 23, thereby insuring optimum current flow. The collet has an enlarged head 27 by means of which it is positioned relative to the stems 11 and 23, the head of the collet coacting with a thermally sensitive ring 28 seated on shoulder 29 in the housing 16, the ring having a tapered annular nose 30 which engages the tapered surface 31** of the enlarged head of the collet and positions the collet so that it overlies substantially equal portions of the upper and lower pin parts. The thermal ring is preferably formed from a thermally sensitive rigid plastic material, such as thermoplastic polyester (polybutyleneterephthacate) manufactured by General Electric Co. under the trademark VALOX or acetal manufactured by E. I. DePont de Nemours & Co. under the trademark DELRIN, which materials have predetermined melting points chosen in accordance with the temperature at which it is desired to interrupt the flow of current through the pin parts.

The collet is urged into contact with the tapered nose of the thermal ring by means of flanged metallic sleeve 32 which surrounds the body of the collet, the sleeve being urged into contact with the enlarged head of the collet by means of helical spring 33 which is normally compressed between the seat 14 and the flanged end of the sleeve 32. As will be evident, the compressed spring 33 seeks to displace the collet axially in the direction of the lower pin part **6*b*, but such movement is restrained by the tapered nose 30 of the thermal ring 28. In addition, the tapered nose 30 performs a camming function in that as the tapered surface 31 of the collet is urged into contact with the tapered nose 30, the inner surfaces of the split ring collet, indicated at 34, will be urged into tight engagement with the head 24 of the stem 23, and also with stem 11**, thereby insuring tight electrical contact between the parts.

Figure 4A:
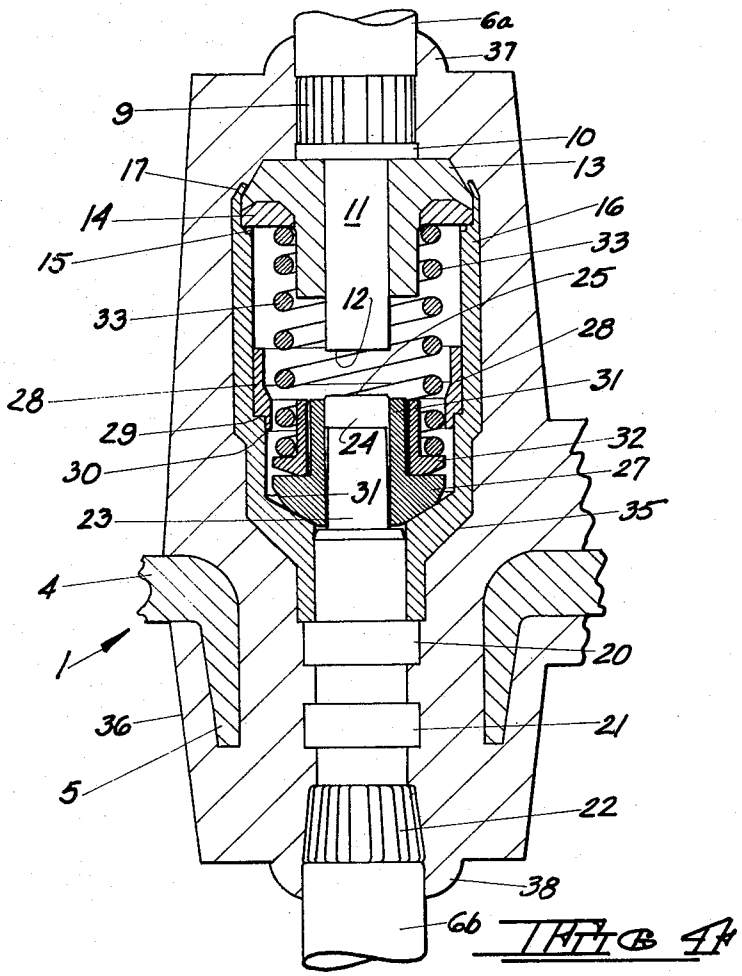
FIG. 4 is an enlarged fragmentary vertical sectional view similar to FIG. 3 but illustrating the position of the parts after the collet has been released.

In the operation of the device, if the pin parts overheat, which is usually due to the malfunction of components connected to the lower pin part 6*b*, the heat will be quickly transferred to the nose of thermal ring 28 both through housing 16 and the enlarged head 27 of the collet, thereby causing the nose of the thermal ring to melt. Since axial displacement of the collet is restrained solely by the tapered nose 30 of the thermal ring, it is only necessary to melt a relatively small quantity of material in order to release the collet for axial movement under the influence of the spring 33. This movement is illustrated in FIG. 4, wherein it will be seen that the nose 30 of the thermal ring has been effectively flattened by the action of tapered surface 31 of the collet as it is urged downwardly by the spring 33. As the collet moves downwardly, contact is broken with stem 11 of the upper pin part 6*a*, the collet moving downwardly into the open lower portion of the casing 16, the uppermost or rear surface of the collet lying substantially in alignment with the face 25 of the lower pin part 6*b*. The faces 12 and 25 of the respective pin parts are thus separated by the full extent of gap 8 and the electrical connection between the pin parts is broken.

In addition to providing the desired thermal interrupt, the configuration of the parts is such that they coact with the molded sealing member 7 to insure a tight hermetic seal between the terminal and the supporting body 1. To this end, the knurled body portions 9 and 22 serve to firmly anchor the parts against rotation relative to the sealing member, and the shoulders 20 and 21 of the lower pin part 6*b*, which lie within the confines of sleeve 5, together with the tapered wall surface 35 of casing 16, which lies immediately above the socket, coact to control the location and degree of contraction of the sealing member, particularly in the portion thereof lying within the confines of the sleeve 5, the parts acting to effectively anchor the sealing member within the confines of the sleeve so as to resist flow or creep of the sealing material axially of the sleeve during molding. This renders the portion of the sealing member lying within the confines of the sleeve relatively unaffected by expansion and contraction of the pin part 6*b* and the surrounding sleeve 5 in the critical area between the inner and outer sides of the terminal, as defined by the base 4 of the supporting body 1. It will be noted that the sealing member 7 includes an annular portion 36 which surrounds the sleeve 5 to further insure the integrity of the bond with the sleeve, and it is also preferred to provide the sealing member with integral collars 37 and 38 at the points where the pin parts 6*a* and 6*b* emerge from the sealing member, such collar acting to relieve stress concentrations which could result in aging cracks in the peripheral areas immediately surrounding the pin parts, the collars also serving as stops against which a plug or the like for receiving the pin parts may be seated.

While a preference has been expressed for sealing materials which are sufficiently compliant to accommodate expansion and contraction of the pin parts, it will be understood that the terminal pins of the present invention may be used with conventional glass-to-metal or ceramic-to-metal seals, although care must be taken to insure that the rate of expansion and contraction of the pin parts is compatible with the sealing material being used. Similar considerations apply to the materials from which the casing 16 is formed. The collet and contact portions of the pin parts preferably will be silver plated to insure lowest electrical contact resistance.

Figure 5:
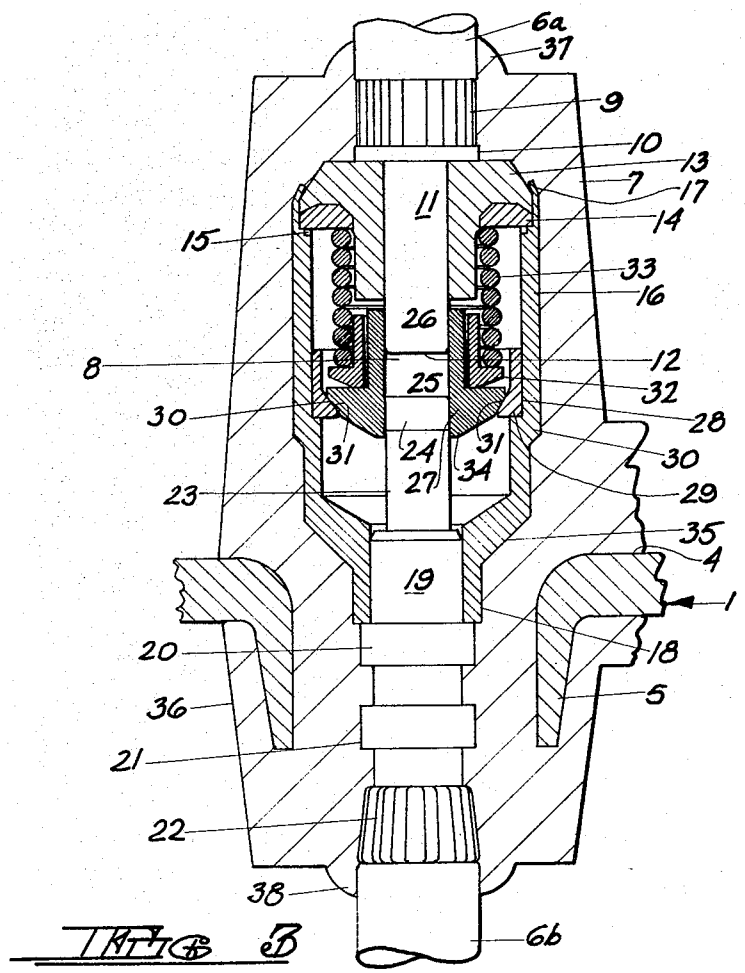
FIG. 5 is a fragmentary vertical sectional view of a terminal pin provided with an arc protector.

In installations where contaminates within the system are conductive and can be deposited on the insulating surfaces of the header, it is preferred to surround the inner pin portions with arc protectors. As seen in FIG. 5, the pin portions 6*b* is surrounded by a protective sleeve 39 which is embedded in and projects outwardly from the annular portion 36 of sealing member 7. The sleeve 39 is preferably made of graphite which has a high sublimation point (6610° F.), a thermal conductivity which is approximately 1/16 that of a copper terminal pin, and an electrical conductivity which is only about 1/820 that of copper. When extraneous currents caused by conductive contaminants flow over the surfaces of the sealing member, they will flow through the protective sleeve and cause heating of the sleeve due to current flow which will enhance early and rapid tripping of the thermally sensitive current interrupting terminal pins. At the same time the protective sleeve will effectively shield the pin part 6*a* from arcing and possible melting of the pin. While a preference is expressed for graphite protector sleeves, various other conductive materials may be used consistent with the objectives of providing a larger area for rapid heat conduction and shielding the pins from arcing.

While the invention has been described in conjunction with a refrigeration header, it will be understood that the terminal pin construction of the invention may be utilized in conjunction with single or multiple terminal pin constructions, or in constructions wherein the body or support for the pins comprises an integral part of a housing or other component to which electric current is to be supplied. It also will be understood that the arc protectors of the present invention may be utilized with other terminal pin constructions, including conventional refrigeration headers, to resist arcing off of the internal part of the terminal pin.

What is claimed is:

1. A temperature responsive terminal pin construction comprising a tubular casing, an axially aligned pair of conductive terminal pin parts inserted in the opposite ends of said casing, means fixedly securing said pin parts in said casing with their innermost ends in spaced apart relation to define a gap therebetween, a split ring collet adapted to surround said pin parts and make electrical contact therewith, said collet having a first position of use in which it bridges the gap between said pin parts, and a second position of use in which said collet is displaced axially so as to open the gap between said pin parts, spring means positioned to urge said collet from its first to its second position of use, and a thermosensitive annular ring having a predetermined melting point positioned to normally maintain said collet in its first position of use against the compression of said spring means, said collet having an enlarged head and said annular ring having a nose engaging the head of the collet, whereby if a temperature sufficient to cause the nose of the thermosensitive ring to melt is generated within the terminal pin, the collet will be released for movement from its first to its second position of use to break the electrical connection between said pin parts, and means in association with the nose of said thermosensitive ring urging the collet into tight engagement with said pin parts when said collet is in its first position of use.

2. The terminal pin construction claimed in claim 1 wherein the means in association with the nose of said thermosensitive ring urging the collet into tight engagement with said pin parts comprises a tapered surface on said nose facing said collet, the head of said collet having a tapered surface contacting the tapered surface of said nose, whereby the tapered surface of said nose acts to cam the collet inwardly into tight engagement with the pin parts when the collet is in its first position of use.

3. The terminal pin construction claimed in claim 2 wherein the pin part surrounded by the head of the collet has an enlarged stem part adapted to be engaged by the collet.

4. The terminal pin construction claimed in claim 3 including a sleeve surrounding said collet, said sleeve having a flange at one end interposed between the head of said collet and said spring means.

5. The terminal pin construction claimed in claim 4 wherein said spring means comprises a helical spring adapted to be maintained in compressed condition when said collet is in its first position of use.

6. The terminal pin construction claimed in claim 5 wherein the means fixedly securing a first of said pin parts to said casing comprises a dielectric cap fitted into one end of the casing, said first pin part extending through said cap.

7. The terminal pin construction claimed in claim 6 wherein the means fixedly securing the other of said pin parts to said casing comprises an integral collar on the opposite end of said casing, said other pin part extending through and secured to said collar.

8. The terminal pin construction claimed in claim 7 wherein said casing is formed from a conductive material, whereby heat may be transferred to said thermosensitive ring both through said conductive member and said casing.

9. The terminal pin construction claimed in claim 1 in combination with a supporting body having a sleeve, and a dielectric sealing member securing said terminal pin to said supporting body with one of said pin parts passing through said sleeve in spaced relation thereto, said sealing member enclosing said sleeve and said casing.

10. The terminal pin construction claimed in claim 9 wherein the pin part extending through said sleeve includes an enlarged shoulder positioned near the outermost end of said sleeve.

11. The terminal pin construction claimed in claim 10 wherein said casing has an outwardly tapered wall surface lying in close proximity to the opposite end of said sleeve.

12. The terminal pin construction claimed in claim 11 wherein said last named pin part includes a second enlarged shoulder intermediate said first named shoulder and the outwardly tapered wall surface of said casing.

13. The terminal pin construction claimed in claim 12 wherein each of said pin parts has a knurled body portion lying beyond said casing, and wherein said knurled body portions lie within the confines of said sealing member.

14. The terminal pin construction claimed in claim 13 wherein the nose of said thermosensitive ring has a tapered surface facing said collet, and the head of the collet has a tapered surface contacting the tapered surface of said nose, whereby the tapered surface of the nose acts as a cam surface to urge the collet into tight engagement with said pin parts under the influence of said spring means.

15. The terminal pin construction claimed in claim 9 wherein the pin part which passes through the sleeve in said supporting body projects outwardly beyond said sealing member, and wherein a protective conductive sleeve surrounds the last named pin part, the protective sleeve projecting outwardly from said sealing member toward the distal end of the said pin part.

16. The terminal pin construction claimed in claim 15 wherein said protective conductive sleeve is made of graphite.

17. A temperature responsive terminal pin construction comprising a supporting body having a sleeve, a terminal pin having a tubular casing, an axially aligned pair of conductive terminal pin parts inserted in the opposite ends of said casing, means securing said pin parts in said casing with their innermost ends in spaced apart relation, displaceable means electrically interconnecting said pin parts, thermosensitive means operable to displace said displaceable means to interrupt the electrical connection between said pin parts when a predetermined temperature is reached, a dielectric sealing member securing said terminal pin to said supporting body with one of said pin parts extending through the sleeve in said supporting body, said sealing member closing said sleeve with a portion of said last named pin part extending outwardly beyond said sealing member, and a protective conductive sleeve surrounding the outwardly extending portion of the said pin part, said protective sleeve extending outwardly from said sealing member toward the distal end of said pin part.

18. The temperature responsive terminal pin construction claimed in claim 17 wherein said protective conductive sleeve is made of graphite.

19. The temperature responsive terminal pin construction claimed in claim 17 wherein said protective conductive sleeve is partially embedded in said sealing member.

* * * * *